United States Patent [19]

Van Steenburgh, Jr.

[11] 4,341,087

[45] Jul. 27, 1982

[54] AUTOMATIC ICE CUBE MAKING APPARATUS

[75] Inventor: Leon R. Van Steenburgh, Jr., Denver, Colo.

[73] Assignee: Mile High Equipment Company, Denver, Colo.

[21] Appl. No.: 252,482

[22] Filed: Apr. 8, 1981

[51] Int. Cl.[3] ..... F25C 1/04

[52] U.S. Cl. ..... 62/233; 62/347; 62/352

[58] Field of Search ..... 62/347, 348, 352, 233, 62/73, 74

[56] References Cited

U.S. PATENT DOCUMENTS

| | | | |
|---|---|---|---|
| 2,613,511 | 10/1952 | Walsh | 62/74 X |
| 2,674,858 | 4/1954 | Magnuson et al. | 62/3 |
| 2,834,189 | 5/1958 | Jaeger | 62/7 |
| 2,949,019 | 8/1960 | Roberts | 62/347 |
| 3,144,755 | 8/1964 | Kattis | 62/137 |
| 3,254,501 | 6/1966 | Brysselbout | 62/138 |
| 3,430,452 | 3/1969 | Dedricks et al. | 62/138 |
| 3,449,920 | 6/1969 | Van Steenburgh, Jr. | 62/136 |
| 3,643,458 | 2/1972 | Linstromberg et al. | 62/155 |
| 3,648,478 | 3/1972 | Linstromberg | 62/157 |
| 3,766,744 | 10/1973 | Morris, Jr. | 62/73 |
| 3,913,349 | 10/1975 | Johnson | 62/352 |
| 3,964,270 | 6/1976 | Dwyer | 62/138 |
| 4,276,751 | 7/1981 | Saltzman et al. | 62/138 |

*Primary Examiner*—William E. Tapolcai

*Attorney, Agent, or Firm*—George R. Clark; Neil M. Rose; Clifford A. Dean

[57] ABSTRACT

Ice cube making apparatus of the type having a vertically disposed evaporator plate with a lattice structure on side thereof in which cubes are formed as water runs down the plate. The ice making cycle is controlled by a timer which is actuated by a pressure responsive switch in the refrigerant line and, upon timing out of the ice forming portion of the cycle, hot gas is delivered to the evaporator to detach the ice slab from the evaporator plate and a mechanical harvest plunger applies a uniform force to the ice slab to overcome capillary forces retaining said ice slab on the evaporator plate.

21 Claims, 16 Drawing Figures

21b
21
21a
11
23
30
19
27
20k
13
27
29
37d
37e
37
37
40
40h
40a
13f
39b
39
39a
13a
28
25
13c
13b
20
17
27
25
35
31a
33
31
28
20l
25

AUTOMATIC ICE CUBE MAKING APPARATUS

BACKGROUND OF THE INVENTION

This invention relates generally to ice cube making apparatus and more specifically to automatic apparatus for making ice cubes under various ambient temperature conditions.

For the purpose of making cube ice for commercial installations, such as restaurants, bars, motels and the like, there are a number of varieties of cube ice machines available on the market. Most of them include some type of chilled plate or mold in or against which water is delivered for freezing into ice cubes. The chilled member, which supplies the cooling for freezing the water, may be termed an evaporator plate, which conventionally includes refrigerant coils disposed on one side of the plate and on the reverse side some sort of pockets or recesses in which the water is frozen into cubes of ice. In some machines the evaporator plate is disposed horizontally and in some machines in a vertical position. Whichever disposition is utilized, the evaporator plate must be designed so that water may be delivered to the plate for freezing into cubes and the frozen cubes may thereafter be removed from the plate, or harvested, as such removal is termed.

In order to facilitate harvesting the ice, the evaporator plate in some machines is disposed in an angled position or a horizontal position with the ice forming molds facing downwardly so that the cubes may be harvested by gravity. That is an arrangement in which the cubes will fall out or away from the evaporator plate as soon as the bond between the two has been broken by thawing the ice at their interface. Examples of ice cube makers having gravity harvesting of the cubes are shown in the U.S. patents to Dedricks et al. No. 3,430,452, Johnson, No. 3,913,349, and Dwyer, No. 3,964,270. In the types of machines characterized by the Dedricks et al. patent and the Johnson patent, the evaporator plates are either in a vertical or near vertical position with the cube forming molds being provided by lattice configurations positioned on the evaporator plates on the side remote from the refrigerant coils. Water delivered across the top of the lattice structure runs downwardly across the face of the evaporator plate with portions thereof freezing in the pockets of the lattice as the water trickles across the plate. In the case of the Dedricks et al. patent structure, horizontally extending walls of the lattice are angled downwardly slightly so that the cubes may be harvested by gravity when released from the evaporator plate. Similarly, in the structure disclosed in the Johnson patent, the evaporator plates are tilted downwardly from the vertical so that the horizontal walls of the lattice are tilted downwardly, again, to permit gravity harvesting of the cubes. There are also similar commercial ice machines in which the evaporator plates are positioned vertically but which utilize mechanical harvesting means to disengage the cubes from a lattice work which is not inclined to permit the gravity harvest. One such machine is disclosed in the U.S. patent to Kattis, No. 3,144,755.

In most of these machines utilizing the lattice form of molds on generally vertically disposed evaporator plates, the ice making cycle is completed only when a complete slab is formed wherein the pockets in the lattice are full of ice and there are bridging connections between the adjacent rows of cubes to form a continuous slab in which all of the cubes are interconnected.

The formation of a continuous slab is important since it facilitates the removal or harvesting of all of the cubes substantially simultaneously. If the cubes were not all connected in a single slab, minor variations in the temperature and the surface texture of the plate or the lattice would result in the cubes being harvested in a random manner with many of the cubes taking longer than average to be disengaged from the evaporator plate and the lattice unless the cubes are individually ejected as they are in some types of machines, as for instance is shown in the above cited Kattis patent. If there is not a mechanical ejector for each cube, the break-up of the slab and the random delivery of the cubes would necessitate lengthening the time for the harvesting portion of the cycle and would, therefore, cut down substantially on the output of the machine.

Accordingly, one of the main goals in ice machines of this general type is to form a proper slab of ice which is uniform across its face so that it may be harvested to produce maximum output from the machine. If the slab is not uniform in thickness, the bridging portions of ice will be weak in some areas having a tendency to break and thereby retard or prevent the rapid harvesting of all of the ice on the evaporator plate. It should also be noted that if the freezing cycle is extended sufficiently to build up sufficiently strong bridging portions in spite of the uneven freezing across the surface of the slab, the bridging portions in some areas will be very thick. It is well known that an ice machine is operating least efficiently during this terminal portion of the cycle when the water being frozen is insulated from the evaporator plate by a maximum thickness of ice. Therefore, it is important to the efficiency of the ice making machine that the cycle be terminated as soon as possible after the ice has built up over all of the conducting portions of the evaporator plate and its lattice structure.

The use of gravity for harvesting ice cubes in commercial ice making apparatus is advantageous since it permits the elimination of any mechanical or hydraulic means which might otherwise be used to displace the cubes from the lattice or molds in which they are formed. However, the force available from gravity to remove the cubes from their molds is very small and thereby introduces additional problems, which, in a large measure, offset the advantages obtainable by the use of gravity harvest. As an example of the kind of problem presented, it was noted above that there are often imperfections or nonuniformities in the evaporator plates which cause the cubes in one or more areas of the evaporator plate to be delayed in their discharge by gravity therefrom. In some instances, there may be a minor burr caused in the soldering, which burr might tend to restrain discharge of a cube from the mold until a substantial amount of thawing or melting of the cube has taken place. However, if a small amount of force is utilized in the harvesting operation of the cycle, any minor imperfections in the evaporator plate and its associated lattice structure would be largely overcome and the slab of ice could be harvested without an undue amount of melting.

Other factors which tend to increase the harvest time when relying on gravity harvest are such things as uneven thawing of the ice slab by the hot gases recycled through the evaporator coil. If the heat is not delivered evenly by the hot gases passing through the evaporator coil, there may tend to be substantial melting in some areas of the ice slab before there has been sufficient melting to completely release all of the cubes so that they will move by gravity out of the lattice structure. Also, the presence of the thin capillary film of water between the ice slab and the evaporator plate as the harvest cycle proceeds tends to create a significant force which is not easily overcome by the very light gravity forces acting on the slab of ice. Because of this retaining force produced by the capillary layer of water, it is often necessary to produce excessive melting before the capillary water drains and the ice slab is released to move by gravity out of the lattice structure.

In considering the refrigeration means associated with the evaporator plate in a typical ice machine, we have noted that the evaporator plate typically includes a coil secured to one side thereof through which the liquid refrigerant is passed. This coil typically takes the form of a copper tube which has a plurality of parallel horizontally disposed legs which traverse the rear face of the evaporator plate and are interconnected by radiused portions of tubing. A refrigerant supply line typically extends from the compressor through a condenser which may be either air or water cooled and then through an expansion valve to an input leg at the bottom of the evaporator plate. The liquid refrigerant than traverses the plate through the serpentine coil, passing back and forth through the adjacent horizontal legs in moving to the uppermost leg which is connected through to the input side of the compressor.

When the freezing cycle is completed and harvesting is begun, a solenoid valve in the refrigerant system is actuated, causing hot gas to be delivered to the evaporator coil instead of liquid refrigerant delivered during the freezing cycle. The hot gas quickly raises the temperature of the evaporator plate and the tubing as well as the lattice, causing the slab along with the cubes to be detached from the surfaces on which they were frozen. The harvesting may not take place immediately since there is a thin film of water between the ice and the evaporator plate including the lattice structure, which tends to retain the slab against the evaporator plate as a consequence of the capillary forces involved.

The lattice is provided with drain holes so that, as a slab moves slightly away from the evaporator plate, the water causing the capillary forces drains out from between the ice and the evaporator plate. Once the water has been drained, the slab may be harvested quickly and easily either by gravity or other means depending upon the type of machine involved.

As was indicated above, the gravity forces acting on a slab of ice are so small that excessive melting of the ice slab is often required before the capillary layer of water drains from between the ice and the evaporator plate. Although mechanical means have often been used in the past to separate or remove cube ice from the molds or lattice structure, such mechanical means have, in general, involved substantial forces which were intended to break the connection between the ice and the mold structure rather than being sufficient to overcome the capillary forces which retain the ice following the initial melting between the slab and the lattice structure.

The efficiency of an ice machine is easy to evaluate in terms of the pounds of ice produced in a 24-hour period by a compressor unit of some predetermined horsepower. It is conventional for manufacturers of ice machines to advertise and sell their ice machines on the basis of the pounds of ice which can be produced in a 24-hour period and the customers are used to buying the machines on this basis. However, it is well known that the actual capacity of an ice machine will vary considerably depending on the ambient conditions to which it is subjected in actual operation. Whether the machine utilizes an air-cooled condenser or a water-cooled condenser, the ambient air temperature or the temperature of the incoming water to the condenser will have a substantial effect on the heat which may be removed from the refrigerant during that portion of the cycle. Oftentimes, ice machines are located in the area of a motel swimming pool where ambient air and water might be above 90° F. The same machine at another time of the year might be expected to function with air temperatures below freezing. Accordingly, it has been a continuing problem for the designers of ice machines to provide a control mechanism which would permit the machine to operate efficiently at varying ambient conditions.

Because of the cycle time variation attributable to the varying ambient conditions, it has been conventional to terminate the ice-making portion of the cycle by use of a sensor or probe which would engage an ice cube or ice slab to ascertain when the freezing process had been completed and the harvest portion of the cycle should begin. The use of such sensors or probes complicates the mechanism of the ice machine and provides an area which is very subject to malfunctioning problems. Accordingly, it would be preferable to employ control means for the freezing cycle which would not utilize probes and sensors which physically engage the ice being formed in the machine.

There are a number of examples in the prior art of ice machines having timers to control the ice making cycle. These examples include the U.S. Pats. to Roberts, No. 2,949,019 and Brysselbout, No. 3,254,501. The Brysselbout patent discloses a timer for controlling the freezing portion of the cycle with the time cycle initiated by a temperature-responsive switch associated with the evaporator plate. The Roberts patent, on the other hand, utilizes a pressure-responsive switch associated with the refrigerant line to initiate the timed harvest portion of the cycle.

BRIEF DESCRIPTION OF THE INVENTION

The present invention involves the utilization of a mechanical harvesting means which applies a very small amount of force to a frozen ice slab sufficient to overcome the force of the capillary water layer between the ice slab and the evaporator plate. In its preferred form, the cube ice making apparatus utilizes an evaporator plate disposed in a generally vertical position with an evaporator coil secured to one side thereof and a lattice structure for molding the ice cubes secured to the opposite face of the evaporator plate. Suitable means are provided to deliver water across the entire width of the upper edge of the lattice structure so that it will flow down across the lattice structure on the evaporator plate. A suitable refrigeration system is associated with the coil on the evaporator plate so as to provide low pressure refrigerant liquid to the coil and thereby cool the evaporator plate to form ice from the water passing across the lattice structure.

For the purpose of harvesting the slab of ice, which is formed by the cubes and the interconnecting bridging portions, there is provided a mechanically driven probe, which is mounted to the rear of the evaporator plate and is provided with means for reciprocating the probe through an opening located centrally or slightly offset with respect to the evaporator plate. At a particular time in the ice making cycle, the probe mechanism is actuated so as to apply a force against the back of the ice slab to displace it from its position as it was formed on the lattice structure side of the evaporator plate.

The probe mechanism includes a slip clutch whereby the mechanism will deliver a predetermined maximum force to the slab of ice, the force being limited so that there will be no breakage of the ice slab in the event that the probe engages the slab prior to the slab's being suitably released from its frozen engagement with the lattice structure on the evaporator plate. The slip clutch is necessary to compensate for cycle time variations which result from variations in the ambient conditions under which the ice machine must operate.

In some instances, particularly in the case of larger evaporator plates, it is desirable to have the plunger offset with respect to the center of the slab of ice so that a cocking or turning force may be exerted against the ice slab to most effectively break the capillary attraction of the melting ice which must be overcome before the ice slab may be harvested or displaced from the lattice structure.

A simplified control circuit is utilized in connection with the refrigeration system to provide for efficient freezing and harvesting of the cube ice made therein. This control circuit includes a pressure controlled switch which initiates the timed freezing portion of the ice making cycle when the refrigerant has attained a certain pressure condition. At a fixed time following initiation of the cycle, the harvesting portion of the cycle is initiated, at which time a solenoid valve is operated in the refrigeration system to deliver hot gas to the evaporator coil and contemporaneously with the initiation of the harvest portion of the cycle, the probe mechanism is actuated to provide the uniform force for displacing the ice slab from the lattice structure as soon as the hot gas has melted the ice sufficiently to permit the probe to overcome the capillary forces and displace the slab with respect to the evaporator plate. As soon as the harvesting has been completed, the ice making cycle begins again with water being delivered to the lattice structure and low pressure liquid refrigerant being delivered to the evaporator coil.

The cube freezing portion of the cycle is a fixed time in all instances starting with the actuation by the pressure control switch in the refrigeration system. Due to the slight variations which will occur in the nature of the ice slab and the speed with which the hot gas will melt the connection between the ice slab and the lattice structure, there is some variation in the time at which the ice slab is adapted to be harvested or displaced with respect to the evaporator plate. The slip clutch provided on the probe mechanism accommodates any such time variation applying a continuing, constant force to the ice slab until such time as it is sufficiently thawed to permit it to be ejected from the lattice structure. Specifically, when operating under low ambient conditions, there is less hot gas to melt the ice during harvesting and, therefore, the cycle requires more slippage in the clutch prior to hot gas having melted the ice sufficiently for harvesting of the slab. On the other hand, when the apparatus is operating under high ambient temperature conditions, the hot gas melts the ice sufficiently early in the harvest cycle so that the probe mechanism displaces the ice slab with a minimum amount of slippage.

The use of the probe providing a small mechanical force for harvesting the ice slabs and the use of a fixed time freezing cycle with no temperature or ice sensing mechanisms provides a simple and efficient means of producing cube ice.

Accordingly, it is an object of the present invention to provide improved ice cube making apparatus utilizing a mechanical probe to harvest an ice slab from a vertically disposed evaporator plate.

It is another object of the present invention to provide an improved ice cube making machine having a refrigeration system controlled by a pressure switch operating a timer which regulates the length of the freezing cycle.

It is another object of the present invention to provide an improved ice cube making machine operating with a fixed freezing time cycle and utilizing a probe mechanism to mechanically harvest a slab of ice from a lattice structure disposed on a vertical evaporator plate.

A further object of the present invention is to provide an improved mechanical means for harvesting ice in a cube making machine including a mechanical probe which reciprocates through an opening in an evaporator plate to displace an ice slab from the lattice structure formed on said plate with the probe being positioned to cock the ice slab to break the capillary forces retaining it with respect to the evaporator plate.

Still another object of the present invention is to provide an improved harvesting means for an ice cube making machine of the type having a vertically disposed evaporator plate with a lattice structure on one side thereof, the means including a reciprocating probe which is movable through an opening in the evaporator plate to displace the ice slab formed thereon with a predetermined force.

DETAILED DESCRIPTION OF THE INVENTION

Figure 1:
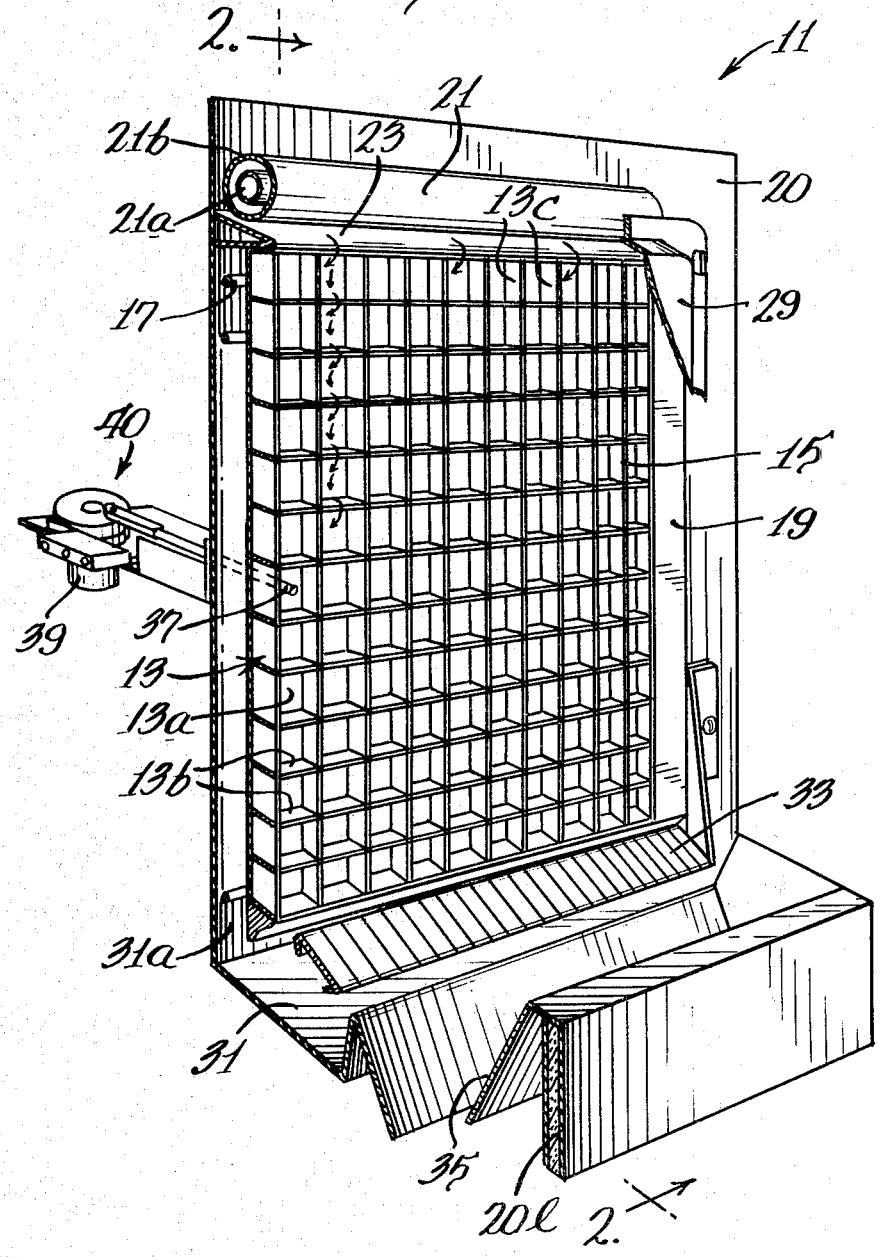
FIG. 1 is a cutaway perspective view of a portion of an ice cube making machine embodying my invention.

Referring to the drawings, there is shown an ice cube making apparatus or machine designated generally by reference numeral 11. The apparatus 11 includes an evaporator plate 13, the details of which are best shown in FIGS. 5–8 and which has a lattice structure 15 secured to the front side thereof and a serpentine refrigerant coil 17 secured to the rear face thereof. The evaporator plate is formed of a copper base member or plate 13*a* to which horizontal walls 13*b* and the vertical wall 13*c* are assembled by soldering to achieve good heat transfer connections between the base plate 13*a* and the walls 13*b* and 13*c*.

Figure 6:
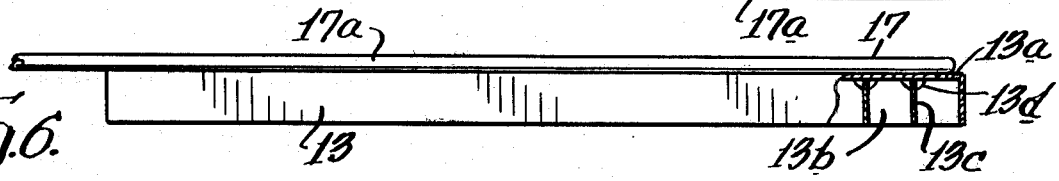
FIG. 6 is a bottom view of the evaporator plate of FIG. 5.
Figure 7:
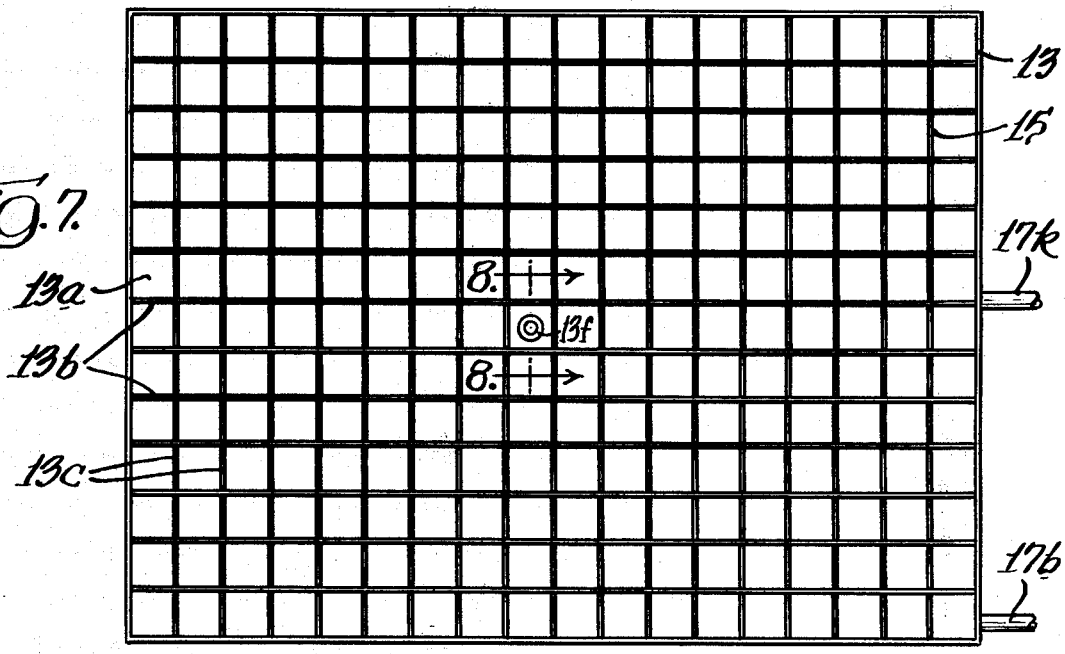
FIG. 7 is a front view of the evaporator plate of FIG. 5.
Figure 8:
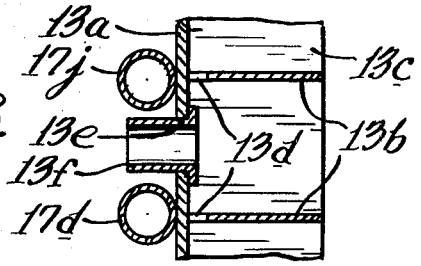
FIG. 8 is an enlarged fragmentary section view of the evaporator plate taken substantially along line 8—8 of FIG. 5.

As is well-known in the art, openings 13*d* are provided in the horizontal walls 13*b* adjacent the base plate 13*a*, as shown in FIGS. 6 and 8, to permit the water to drain from between the ice and the evaporator plate during the harvesting portion of the cycle.

The horizontal walls 13*b*, the vertical walls 13*c*, and the base member or plate 13*a* form a plurality of sidewardly opening pockets within which water is frozen to form ice cubes. The evaporator plate 13 is supported by a frame 19, which is supported in a housing designated generally by reference numeral 20 and best shown in FIGS. 3 and 4. The housing 20 is formed by walls made of sheet metal with insulating foam between the inner and outer walls. The lower portion of the housing 20 is formed by an ice storage bin 20*a* having an inner sheet metal wall 20*b*, and outer sheet metal wall 20*c* and foamed in place insulation therebetween. The storage bin 20*a* includes an access door 20*d* and a water drain 20*e*. Superimposed on the storage bin 20*a* is a cabinet portion 20*f* of the housing 20. The cabinet portion 20*f* includes rear wall 20*g*, top wall 20*h* and side walls 20*i* which are supported by a horizontal wall 20*j* and a vertical wall 20*k*. The evaporator supporting frame 19 is mounted on the front of the vertical wall 20*k*. The front of the cabinet portion 20*f* is defined in part by a low wall 201 which is below a forwardly facing access opening 20*m*. The evaporator plate 13 is accessible through the opening 20*m*.

Immediately above the evaporator plate 13, the frame 19 supports a water delivery tube 21, which extends the entire width of the evaporator plate. The water delivery tube 21 comprises concentric tubes 21*a* and 21*b* which are designed to deliver the water evenly over the length of an angled plate 23 from which the water runs downwardly onto the lattice 15 of the evaporator plate 13. The internal tube 21*a* of the water delivery tube 21 is connected to a source of water and has upwardly facing openings spaced along the length of the tube to supply water to the interior of the larger tube 21*b*. The tube 21*b*, in turn, is provided with a plurality of aligned spaced openings on its lowermost portion which deliver the water across the length of the tube and provide equal flow from the openings along the length of the water delivery tube 21. As the water flows by gravity downwardly across the evaporator plate 13, the capillary action of the water with respect to the horizontal walls 13*b* permits the water to follow the walls of the lattice structure 15 thereby wetting the entire surface of the evaporator plate and its associated lattice structure 15. The cooling effect provided by the low pressure liquid passing through the refrigerant coil 17 chills the base plate 13*a* and the associated walls 13*b* and 13*c* of the lattice structure 15 causing the water passing downwardly over the evaporator plate 13 to freeze.

Because of the high thermal conductivity of the base plate 13*a* and the walls 13*b* and 13*c*, the freezing of the cubes takes place on all of the walls of the pockets formed by the lattice 15 ultimately resulting in complete ice cubes being formed. As the freezing of the cubes is completed, as may best be seen in FIG. 2, bridging sections 25 are formed between the adjacent cubes thereby creating a slab 27 in which the individual cubes 28 are connected by the bridging sections 25.

One of the most important aspects of an ice machine insofar as efficiency is concerned is the manner in which the ice cubes are removed from the cube forming molds or harvested after they have been frozen. A considerable amount of energy and time must be expended to freeze cubes of a particular size and weight. In order to detach the cubes from the molds in which they are formed it is necessary to supply a considerable amount of mechanical force or to thaw the ice along the surfaces of the forming molds so the ice may be displaced from the molds with the use of a minimal amount of power. However, the melting of the ice in connection with the harvesting or cube removal represents an entirely unproductive portion of the cycle which tends to subtract from the efficiency which may have been achieved during the freezing portion of the cycle. Accordingly, it is desirable to minimize the melting of the cubes during the harvesting portion of the cycle. One of the problems associated with gravity harvesting of ice is that it is often necessary to melt a greater percentage of the cubes than would be necessary if a mechanical harvesting were used to detach the cubes from the ice forming mold. In addition, to obtain harvesting in an optimum period of time, it is necessary to harvest the entire unbroken slab of ice with a minimum of cocking or displacement of the slab prior to its freeing itself from the evaporator plate. The present invention utilizes a vertically positioned evaporator plate and low force mechanical means to separate the slab of ice from the evaporator as soon as sufficient thawing has taken place in the harvest portion of the cycle.

Figure 2:
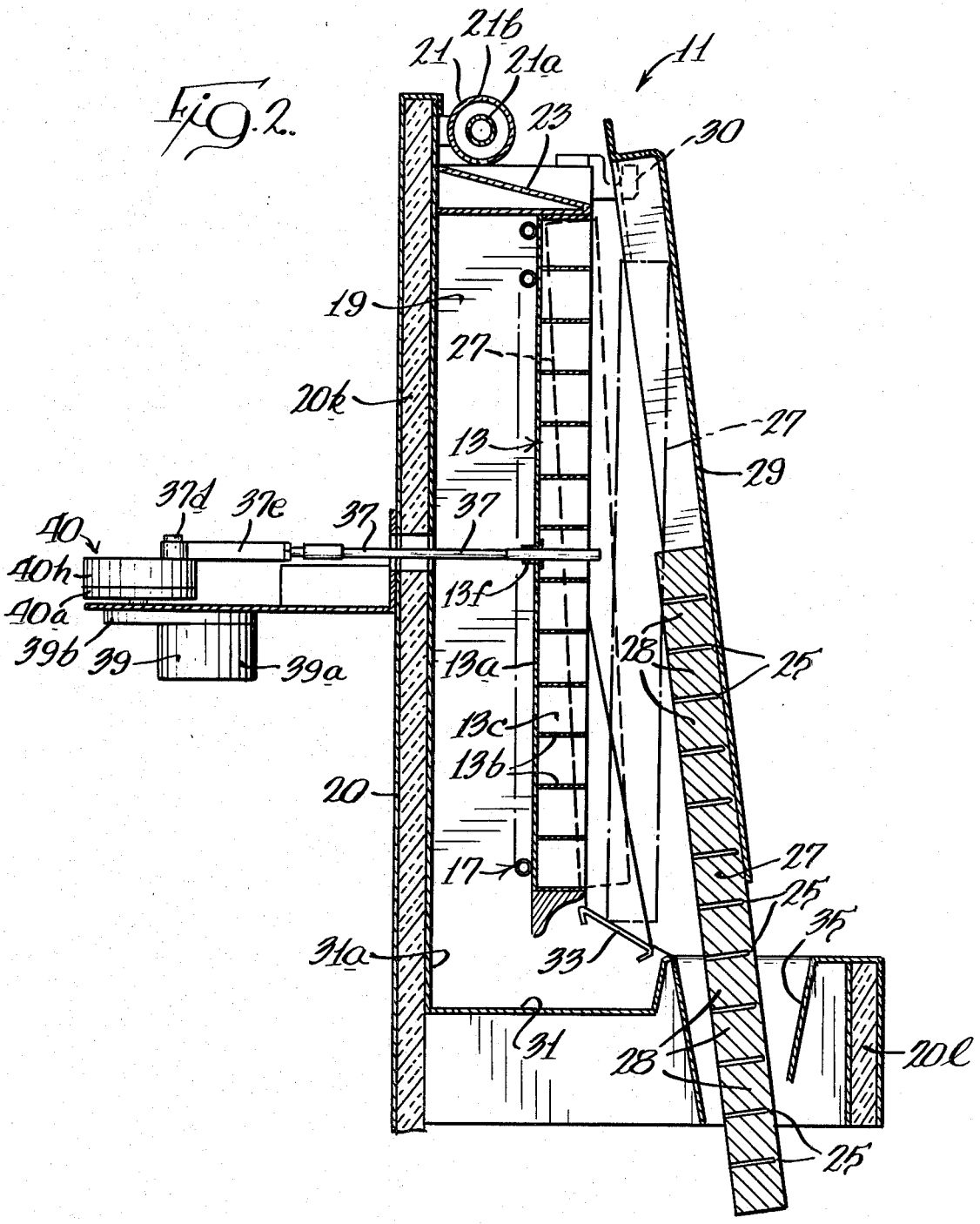
FIG. 2 is a section view taken substantially on line 2—2 of FIG. 1.
Figure 4:
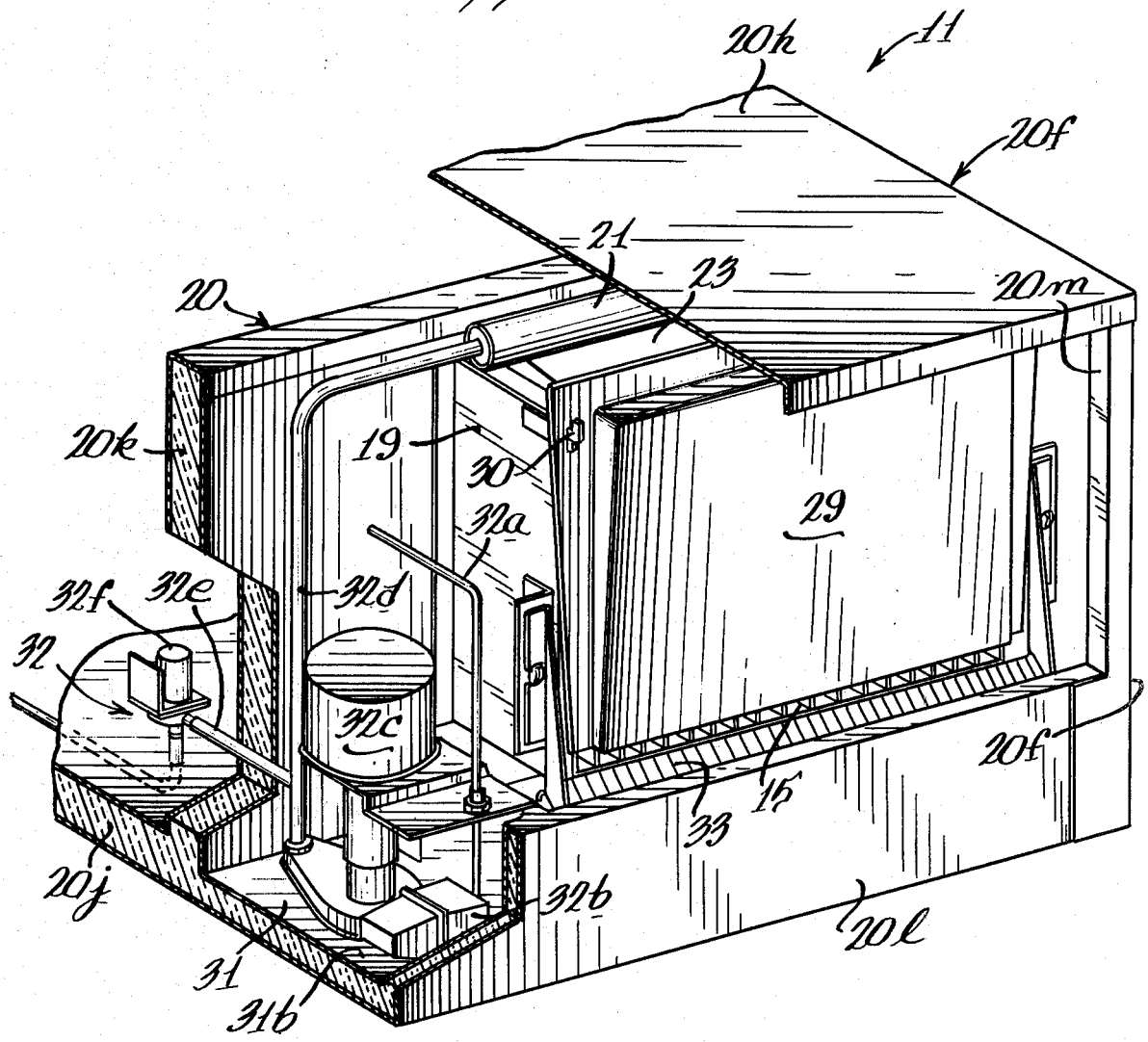
FIG. 4 is a fragmentary perspective view of a portion of the ice cube making machine of FIG. 3.
Figure 5:
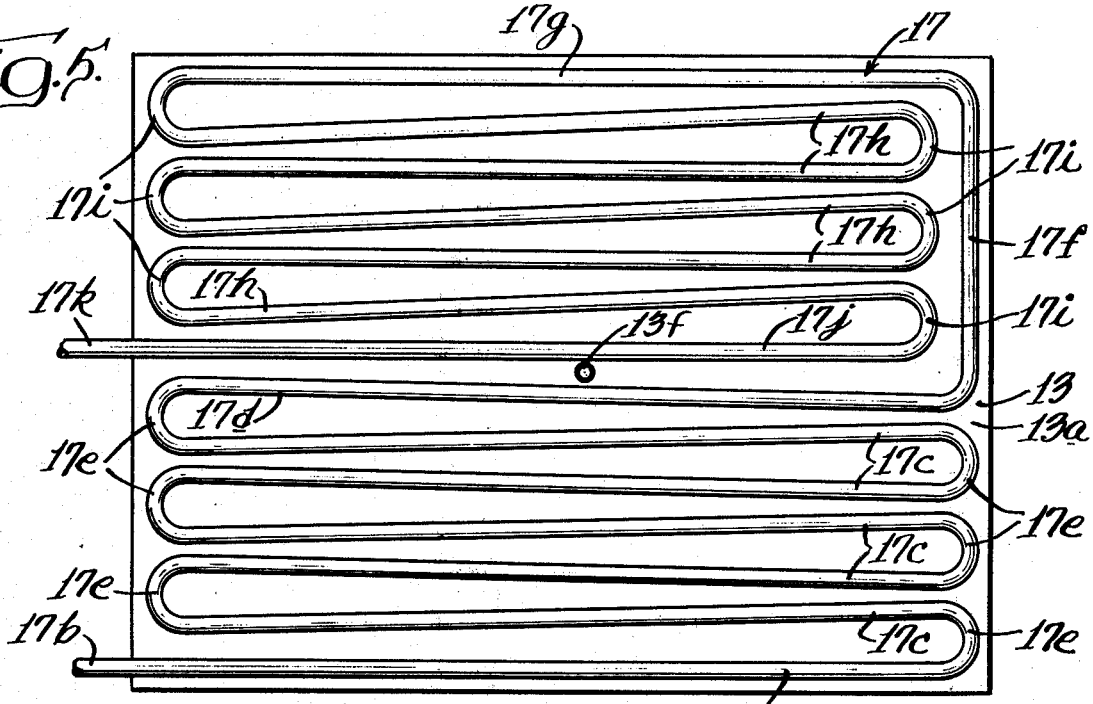
FIG. 5 is a rear view of an evaporator plate embodied in the ice cube making machine of FIGS. 1–4.

Referring to FIG. 2, there is shown a slab of ice 27 in the various positions through which it moves during the harvesting process. The ice cube making apparatus 11 includes a cover member 29, which is pivotally connected to the frame 19 for swinging movement about its upper edge by hooks 30, as shown in FIGS. 2 and 4. In its normal position during the freezing portion of the cycle, the cover 29 extends substantially vertically and deflects any water which might splash from the front of the evaporator plate 13. Thus, all of the water passing across the evaporator plate 13 drains into a reservoir 31 in the event that it is not frozen as it traverses the lattice 15 on the evaporator plate 13.

Figure 3:
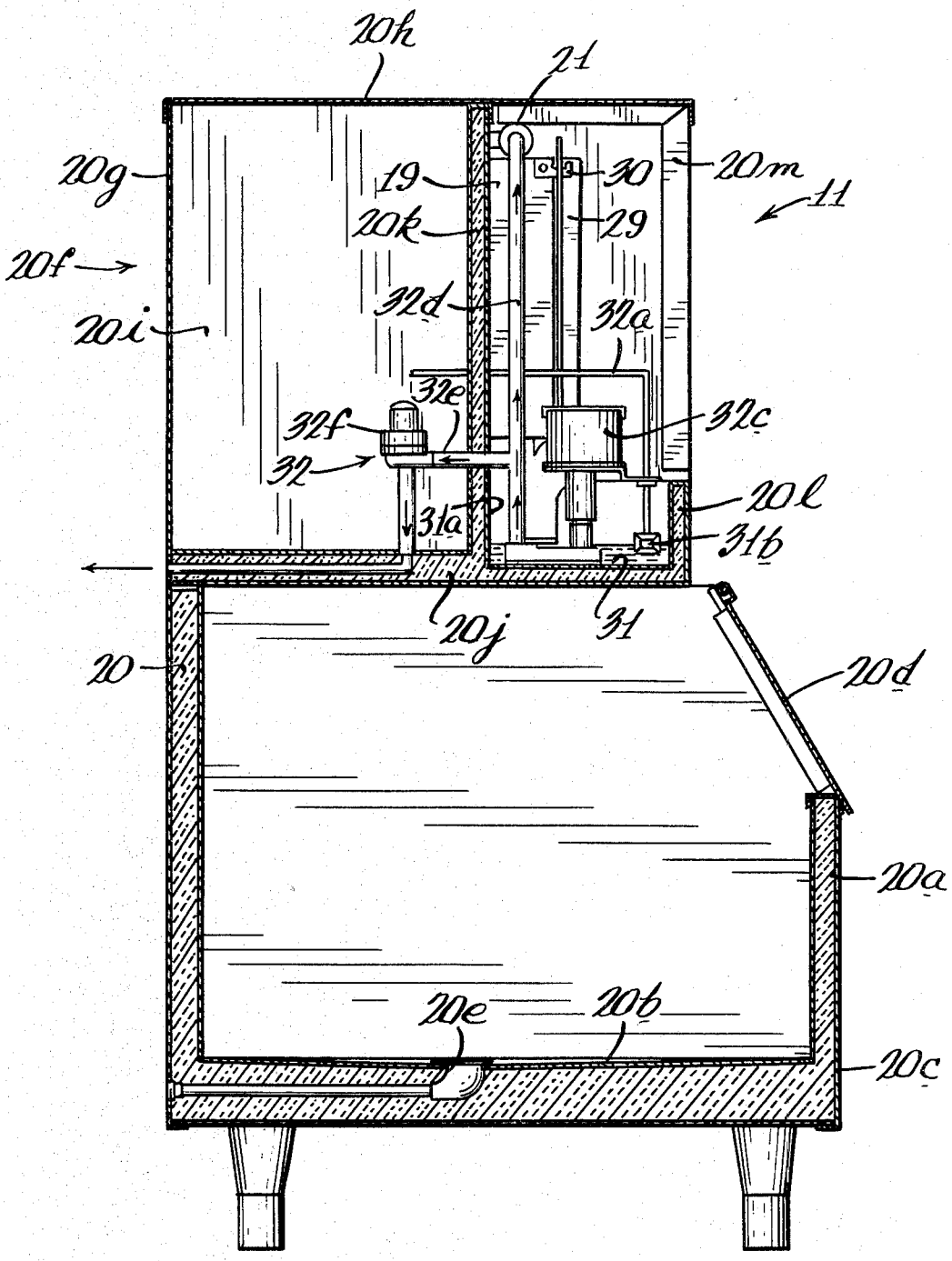
FIG. 3 is a sectional view of an ice cube making machine embodying my invention and disclosing the housing portions and the water circulation portions thereof.

A reservoir 31 extends the length of the evaporator plate 13 having a portion 31*a* beneath the evaporator plate 13 and having an enlarged sump portion 31*b* at the left end of the evaporator plate 13, as viewed in FIG. 4. For the purpose of circulating and distributing the water to the delivery tube 21, there is provided a water circulation system 32, which is best shown in FIGS. 3 and 4. The water circulation system 32 includes a water supply tube 32*a*, which is controlled by a known float mechanism 32*b* to maintain a constant water level within the reservoir 31. The water circulation system 32 also includes a motor driven pump 32*c*, which is capable of delivering water through the tube 32*d* from the sump portion 31*b* to the water delivery tube 21 during the freezing portion of the cycle. Also connected in the water line 32*d* is a purge water line 32*e*, which is connected to the water drain and is controlled by normally closed solenoid valve 32*f*. As will be explained in greater detail below, water may be purged by pumping water to the drain by energizing pump 32*c* and at the same time energizing the solenoid valve 32*f* in order to open the valve. With the valve 32*f* open, the water delivered by the pump 32*c* passes through the water drain line 32*e* rather than flowing upwardly through the water line 32*d* to the delivery tube 21.

It is conventional in ice machines of this type to provide means for periodically purging the water reservoir in order to eliminate the accumulation of impurities in the water contained in the reservoir. If the water were continually recycled from the reservoir across the evaporator plate with sufficient water only added to replace the water frozen into cubes, the impurities contained in the reservoir water would continuously increase until they reached objectionable levels. With the cyclic purging of the water from the lowermost portion of the reservoir, i.e., the sump 31*b*, these impurities are removed and delivered to the drain.

At the lower edge of the evaporator plate 13 there is provided an ice deflection grating 33, which comprises a plurality of ribs through which water must pass into the reservoir 31, but which are sufficiently close together to prevent ice cubes from entering the reservoir 31. Any ice cubes impinging on the angled grating 33 are deflected laterally into an opening 35, which communicates with a cube storage bin 20*a*.

As illustrated in FIG. 2 by the initial two dotted line showings of the slab of ice cubes 27, the slab is initially displaced with the bottom moving outwardly in response to force exerted by a harvesting plunger 37. At a predetermined point in the freezing cycle, the flow of water across the evaporator plate is terminated, and the path of the refrigerant is changed by opening a solenoid valve in the output of the compressor so that hot gas is delivered to the refrigerant coil 13 rather than the low pressure liquid which produces the cooling in the evaporator plate. At the same time, the harvesting plunger 37 is activated by a motor 39 which reciprocates the plunger 37 through an opening 13*e* in the base plate 13*a* to engage a point on the slab 27 which is displaced horizontally a slight distance from the geometric center of the slab 27.

The specific location of the opening 13*e* and the amount of displacement with respect to the center point of the evaporator plate depends to a large extent on the geometry of the evaporator plate. In small ice cube making machines where the number of cubes and the capillary force exerted by the melting ice is small, it has been found that satisfactory results are achieved when probe or harvesting plunger 37 is positioned at the geometric center of the evaporator plate. The term geometric center of the plate as used herein means a point on the evaporator base plate 13*a* at the midpoint between the sides and the midpoint between the upper and lower edges. This assumes that there is an odd number of rows of cubes both in the vertical and horizontal direction leaving one cube or one cube forming pocket in the lattice at the geometric center of the evaporator plate as viewed as in FIG. 7.

However, as the size of the evaporator plate 13 increases with larger ice cube making machines, it becomes more important to displace the opening 13*e* and the associated probe or plunger 37 away from the geometric center so as to produce a cocking or twisting moment on the ice slab 27. Were it not for the cocking or twisting moment, the large evaporator plates would require excessive forces and delays in the harvesting cycle before the capillary forces developed by the water film between the ice and the evaporator plate could be overcome. Therefore, in the larger evaporator plates, it is preferred to form the lattice structure 15 with an odd number of horizontal rows as counted in the vertical direction and an even number of vertical rows as counted in the horizontal direction. This permits the opening 13*e* to be placed equidistant between the top and bottom of the evaporator plate 13, while it may be displaced one half a cube from the center line running vertically through the evaporator plate 13. In the example shown in FIG. 7, there are 13 horizontal rows and 18 vertical rows. The opening 13*e* is positioned on the horizontal center line, half way between the upper and lower edges in the seventh row from the bottom or from the top, while the opening 13*e* is displaced half a cube to the left of the partition which runs between the rows of cubes on either side of the vertical center line. This half cube displacement from the vertical center line results in a cocking or twisting moment being applied to the ice slab 27 by the plunger or probe 37 thereby causing the drainage of the capillary film and the release of the capillary forces sooner and at a lower force level than would be required than if the force were applied at the center of the ice slab 27.

Figure 9:
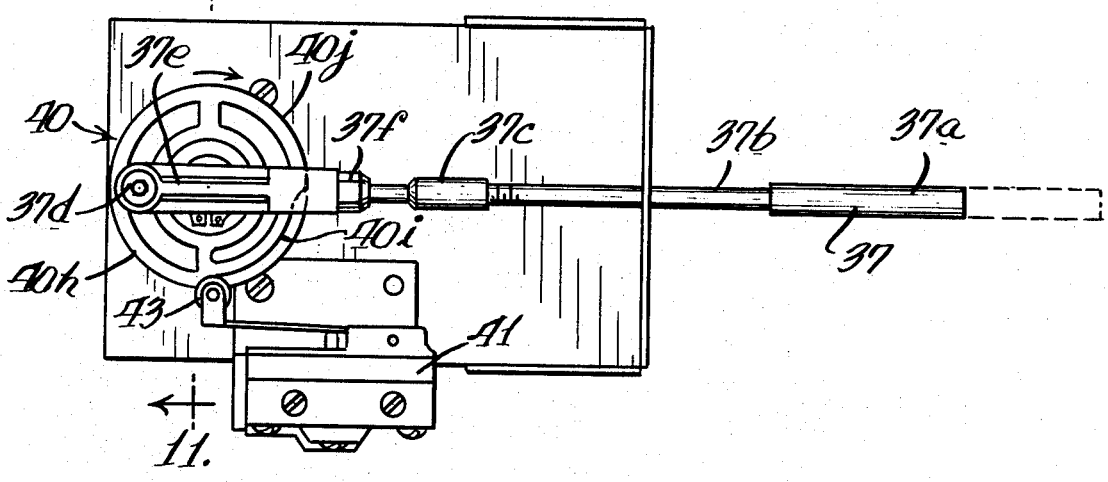
FIG. 9 is an enlarged top plan view of the harvest motor and probe mechanism for displacing the cube ice from the mold on which it is formed in accordance with my invention.
Figure 10:
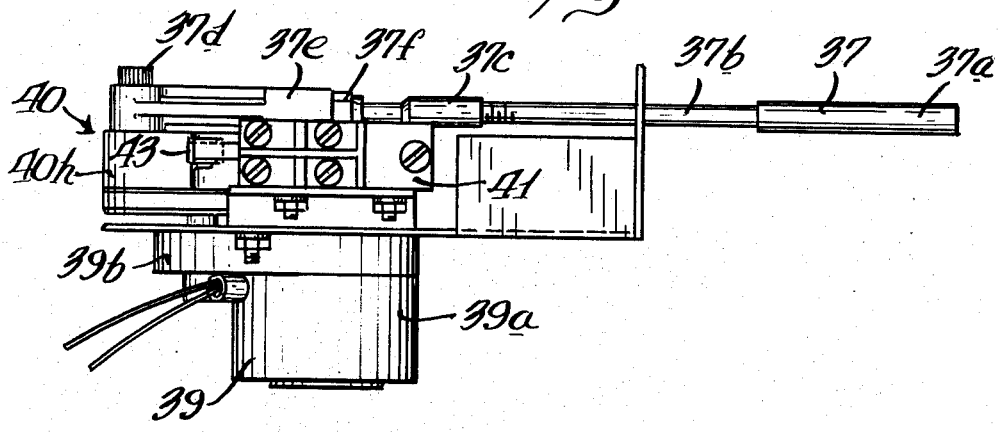
FIG. 10 is a side elevational view of the motor and probe mechanism of FIG. 9.
Figure 11:
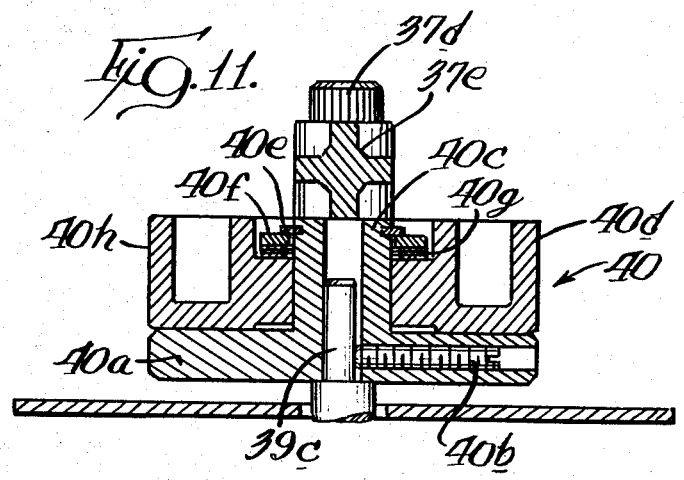
FIG. 11 is an enlarged fragmentary sectional view taken substantially on line 11—11 of FIG. 9 showing the slip clutch included in the probe mechanism.

As is shown in FIG. 8, the opening 13*e* is provided with a bushing or ferrule 13*f* which extends through the opening 13*e* and projects a distance rearwardly of the base plate 13*a*. The bushing 13*f* supports and guides the end of the harvesting plunger 37 as it moves during the harvesting portion of the cycle. Although the harvest motor 39 and the associated plunger 37 are shown only schematically in FIG. 2, reference may be had to FIGS. 9 through 11 for a more detailed disclosure of the means for applying the mechanical force to harvest the ice slab 27. The motor 39 includes a small synchronous electric motor 39*a* which drives a gear train 39*b* which is coupled to an output shaft 39*c*. Interconnecting the output shaft 39*c* and the plunger or probe 37 is a combination cam and slip clutch 40 which is illustrated in FIGS. 9 through 11.

The cam and slip clutch 40 is designed to provide a means of delivering a predetermined amount of force to the probe 37. In using a mechanical probe engaging a single point in the ice slab 27, it is important that a predetermined amount of force be applied so as to achieve a uniformity in the harvesting of the ice slab regardless of the various ambient temperature conditions under which the machine 11 is operating. If an excessive amount of force were applied by the probe 37 before the thawing of the connection between the ice slab 27 and the evaporator 13 has been accomplished, there would be a risk that the ice slab might break leaving portions thereof retained in the lattice 15 where it would perhaps never be harvested and where it would interfere with the next freezing cycle and thereby lower the efficiency of the machine. As explained above, it is important that the ice slab be harvested uniformly and completely without any breaking of the ice slab regardless of the ambient conditions. The slip clutch mechanism which permits the application of a predetermined mechanical force also assures that the ice slab will be harvested or displaced from the evaporator plate 13 as soon as it is thawed sufficiently since the predetermined force is optimum to separate the ice slab from the evaporator 13 as soon as there has been sufficiently thawing.

The cam and slip clutch 40 includes a drive member 40*a* having a set screw 40*b* or other suitable means to affix it to the output shaft 39*c*. The drive member 40*a* includes a hub portion 40*c* on which is received a driven member or cam 40*d*. The hub portion 40*c* has at its outer end a groove in which a snap ring 40*e* is received to hold in clamped relationship a first washer 40*f* and a plurality of spring washers 40*g*. The washers 40*f* and 40*g* bias the driving member 40*d* into engagement with a complementary face on the driving member 40*a*. Thus, the shaft 39*c* will drive the driven member 40*d* until such time as the load thereon exceeds the frictional force which can be transmitted through the interconnecting faces of the members 40*a* and 40*d*. By selection of the spring washers 40*g*, it is possible to achieve a predetermined output force in the probe 37 before slippage occurs in the abutting faces of the members 40*a* and 40*d*.

The harvesting plunger or probe 37 includes an outer plastic end portion 37*a* which is received on a shaft 37*b* which is threadedly engaged with a coupling member 37*c*. The threaded engagement between the shaft 37*b* and the coupling member 37*c* permits adjustment of the position of the probe to compensate for tolerance variations. The plunger 37 is connected to the driven member 40*d* through an eccentric pin 37*d* which is threadedly received in the outer face of the driving member 40*d* and pivotally supports a connecting rod 37*e* which, in turn, is joined through a ball connection 37*f* to the coupling member 37*c*. Thus, as the cam and slip clutch member 40 rotates as driven by the motor 39, the eccentric connection 37*d* causes the end of the plunger 37*a* to reciprocate through the opening 13*e* in the evaporator plate 13. As will be explained in greater detail in connection with the control circuit for the ice machine 11, there is associated with the harvest motor 39 and the plunger 37, a switch 41 which is normally closed but which is operable by roller cam arm 43 which engages a cam surface 40*h* disposed on the outer surface of the driven member 40*d*. The cam surface 40*h* has a reduced diameter section 40*i* which extends around about 90° of the cam surface 40*h* and a larger diameter surface 40*j* which extends around the other 270° of the cam surface 40*h*. As shown in FIG. 9, the cam and slip clutch 40 rotates in clockwise direction, it being disposed initially in the normally closed position and it will remain in the normally closed position for the first 90° rotation of the cam and slip clutch 40. Thereafter, the cam surface 40*j* causes the arm 43 to deflect thereby closing the switch 41.

As the slab 27 moves free of the lattice 15, it falls downwardly striking the grating 33, as shown in FIG. 2. The cover 29 pivots outwardly at the bottom when engaged by the slab 27 and permits the slab 27 to fall through the opening 35 into the storage bin 20*a*. Thus, the movement of the slab 27 as it moves from the evaporator plate 13 into the storage bin is guided by the grating 33 and the cover 29, the upper end of which restrains the outward movement of slab 27, as illustrated in FIG. 2.

Referring now to FIGS. 5 to 8, it is noted that the evaporator plate 13 is of generally rectangular configuration. The base plate 13*a* supports on its rear surface the refrigerant coil 17 which is uniquely arranged to provide the optimum results in the freezing portion of the cycle as well as optimum results in the harvesting portion of the cycle. The details of the evaporator plate are disclosed and claimed in my copending application filed concurrently herewith. It has been conventional in the past to secure refrigerant coils to evaporator plates in a manner which facilitates manufacture accepting the proposition that the cooling effect delivered over the length of the coil will be substantially constant per unit of length. While this assumption is not correct, as will be explained in further detail below, it is also noted that the load on the evaporator plate is in no way constant thereby making it desirable to provide increased cooling to certain portions of the evaporator plate during the freezing cycle and to provide different patterns of thawing during the harvesting portion of the cycle.

To accomplish these objectives, I have provided an evaporator plate 13 having the refrigerant coil 17 disposed with an input leg 17*a* at the bottom edge of the base plate 13*a* with the coil 17 having an input end 17*b*. Extending in spaced generally parallel relation to the input leg 17*a* are intermediate legs 17*c* and a centrally disposed leg 17*d*. The legs 17*a*, 17*c* and 17*d* are all connected by 180° turn connections 17*e*. The end of the leg 17*d*, most remote from the input 17*b*, is connected by vertical leg 17*f*, which extends to the top edge of the base plate 13*a* where it interconnects with a horizontally extending leg 17*g* on the upper edge of the base plate 13*a*. Disposed below the leg 17*g* and in spaced generally parallel relation thereto are further legs 17*h* which are all interconnected by 180° turns 17*i* to the output leg 17*j* which terminates in an output end 17*k*. The low pressure liquid refrigerant is introduced into the coil 17 at 17*b* from where it passes through the continuous coil 17 to the outlet 17*k*. By the time the low pressure liquid has arrived at the output leg 17*j*, it has lost much of its cooling capacity and become a superheated gas which is returned to the compressor in the refrigeration system.

To understand the basic reasons behind the arrangement or disposition of the various legs of the refrigerant coil 17, the manner in which the low pressure liquid passes through the coil 17 and the manner in which the heat is absorbed thereby should be understood. In the input leg 17*a*, the low pressure liquid is at its minimum temperature, however, because of the higher velocity in this portion of the coil 17, it is less effective than when the velocity decreases to some extent. Therefore, the maximum effectiveness of the low pressure liquid is achieved in legs 17*d* and 17*g* when the temperature is still reasonably low and the velocity is considerably decreased from that existing in the input leg 17*a*. As the temperature of the low pressure liquid continues to increase in the legs 17*h*, the refrigerant ultimately reaches a stage where it is a superheated gas as it enters the output leg 17*j*. Because of these relative efficiencies the cooling effect of the legs 17*j* and 17*d* tend to equalize to produce a relatively uniform heating effect across the face of the base plate 13*a*.

Although it might seem that the high efficiency in the leg 17*g* might produce more cooling or ice freezing capacity in this portion of the evaporator plate, it should be noted that the upper edge of the evaporator plate is under a substantially greater load since the water is initially delivered at the upper edge of the evaporator plate 13 and any cooling of the water to the freezing temperature must load that portion of the evaporator plate more than any other portion thereof.

The construction of the evaporator plate is conventional insofar as the use of copper elements which are soldered together is concerned. The base plate 13*a* may have its edges formed up to provide the outermost walls 13*b* and 13*c* of the lattice 15, as is shown in part by the sectioned area in FIG. 6.

With respect to the harvesting portion of the cycle, it has been found that the coil distribution described above provides further significant advantages. In the prior art, the major portion of the heating provided by the hot gas cycled to the evaporator coil caused extreme melting at one edge of the slab with the far edge being the last to be released. This resulted in cocking or displacement of the slab, severe melting of the cubes in the lower rows and often caused breakage of the bridge sections resulting in incomplete or extended harvesting periods. In my arrangement the hot gas is effective in releasing the slab 27 at the upper and lower edges of the evaporator plate while the central portion disposed adjacent the leg 17*j* tends to be the last to separate from the evaporator plate. It has been found that the slab 27, under these conditions, will have less tendency to cock or displace until such time as final thawing along the central horizontal portion of the evaporator plate has occurred. Without such cocking and displacement, the thawing elsewhere on the slab is minimized being limited to a relatively thin layer of ice which is merely sufficient to detach the slab from the adjacent portions of the evaporator plate. Thus, the slab may be harvested in a minimum period of time with a minimum amount of melting in the individual cubes.

Figure 16:
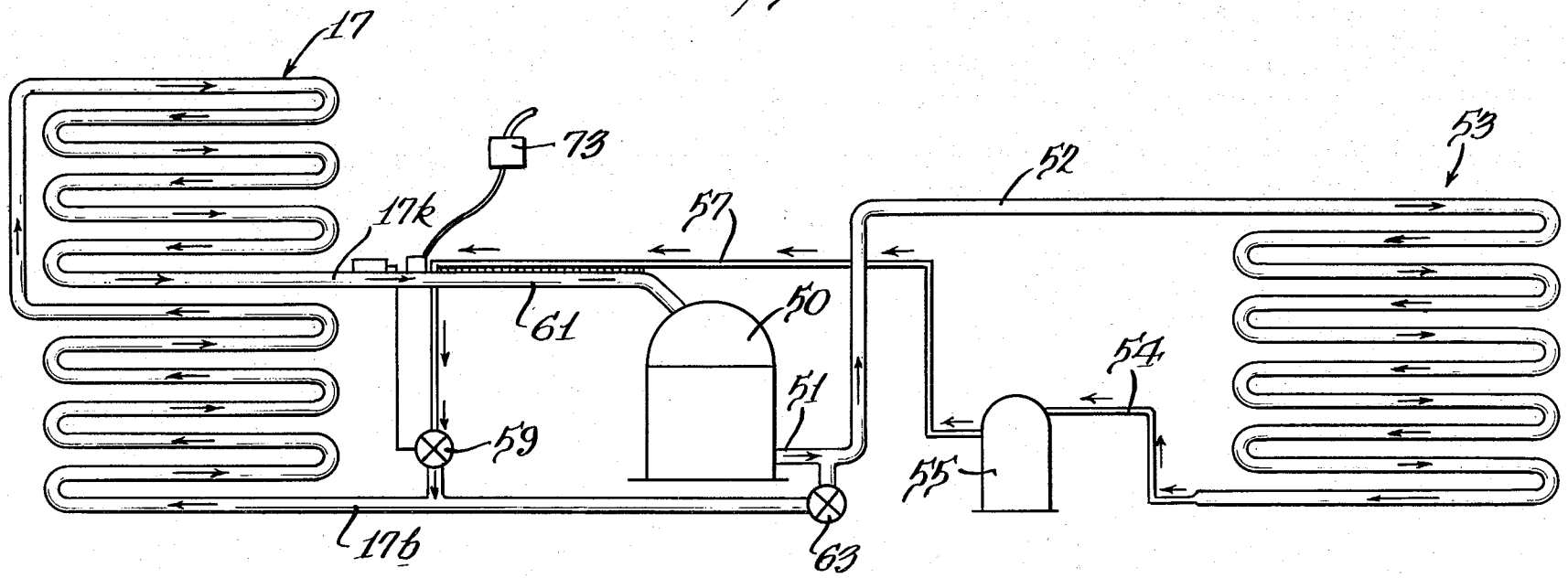
FIG. 16 is a schematic showing of the refrigeration system employed with the ice cube making machine of my invention.

To better understand the novel control circuit which forms a part of my invention, reference should be had to the circuit diagrams of FIGS. 12 through 15 and the diagram of the refrigerant system as shown in FIG. 16. The refrigerant system is generally conventional except insofar as the configuration of the evaporator coil 17 is concerned. The concept of utilizing a compressor with solenoid valve means for controlling the selective delivery of either low pressure liquid or hot gas to the evaporator coil in an ice making machine is old and well known in the art. For the purposes of illustration, there is shown in FIG. 16 a refrigeration system which includes a compressor 50, which compresses and delivers a high pressure gas through an outlet conduit 51. During the freezing portion of the cycle, the high pressure gas from the outlet conduit 51 is delivered through a conduit 52 to a condenser 53 wherein heat is extracted to convert the high pressure gas to a high pressure liquid which is then delivered through a conduit 54 to a reserve storage tank 55. A conduit 57 interconnects the reserve storage tank 55 to the input 17*b* of the evaporator coil 17 through an expansion valve 59. The output 17*k* of the evaporator coil 17 is connected to the compressor 50 by a conduit 61. The valve 59 is an expansion valve through which the pressure on the circulating refrigerant is reduced prior to its being circulated through the evaporator coil 17.

For use in connection with the harvest portion of the cycle, there is provided a hot gas solenoid 63 in a bypass line 65 which interconnects the outlet 51 of the compressor 50 with the evaporator coil 17. This arrangement permits the evaporator coil 17 to be flooded with hot gas by opening the solenoid valve 63 at the beginning of the harvest portion of the cycle.

Figure 12:
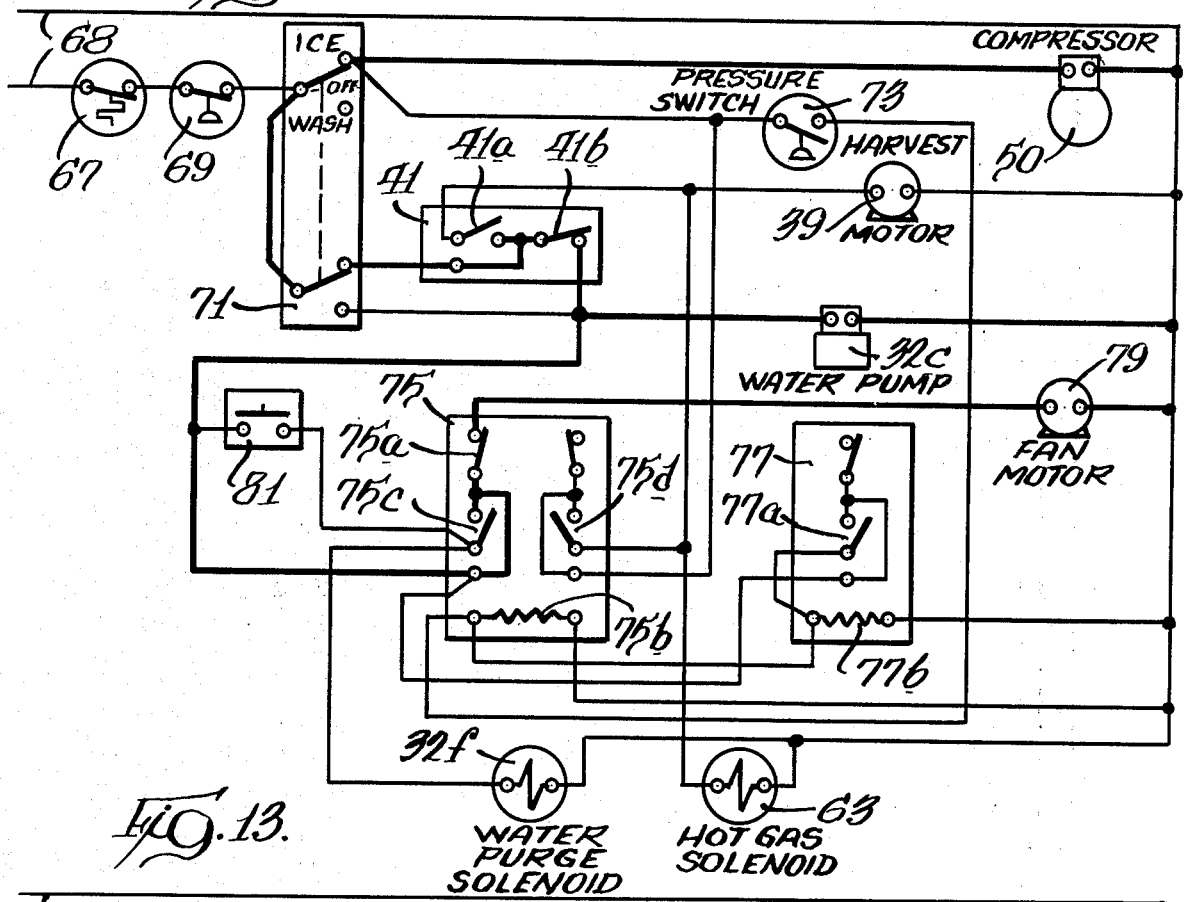
FIG. 12 is a circuit diagram showing the control circuit in its initial condition prior to commencement of the timed freezing portion of the ice cube making cycle.
Figure 13:
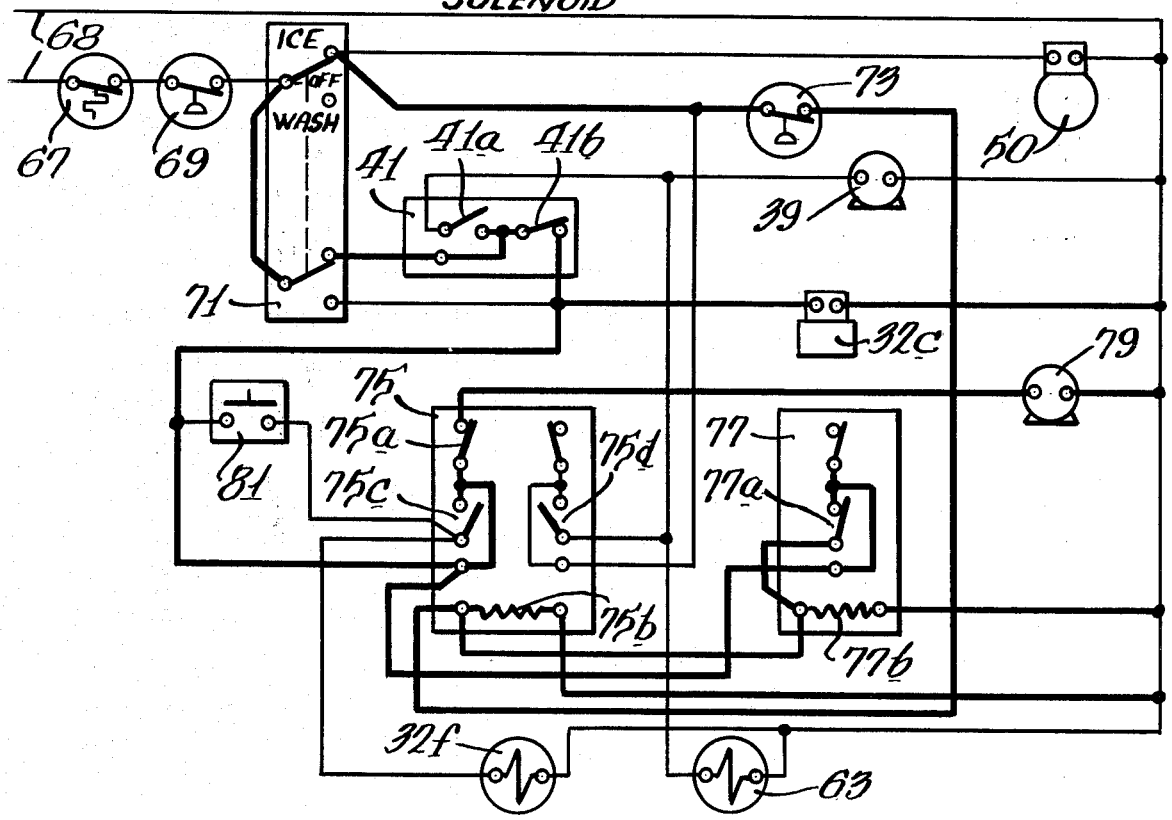
FIG. 13 shows the circuit diagram of FIG. 12 when the timed freezing portion of the cycle has begun.
Figure 14:
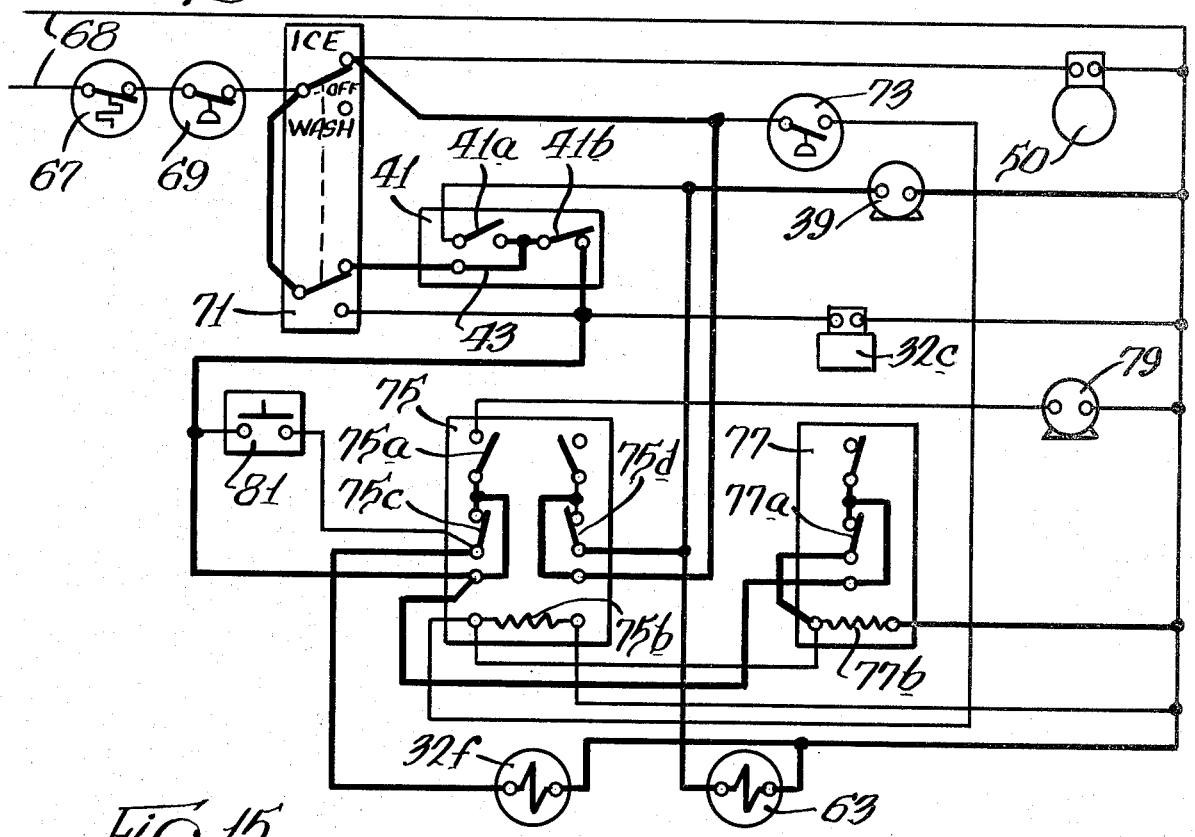
FIG. 14 shows the circuit diagram of FIG. 12 after the timer has timed out and the harvest portion of the cycle has begun.
Figure 15:
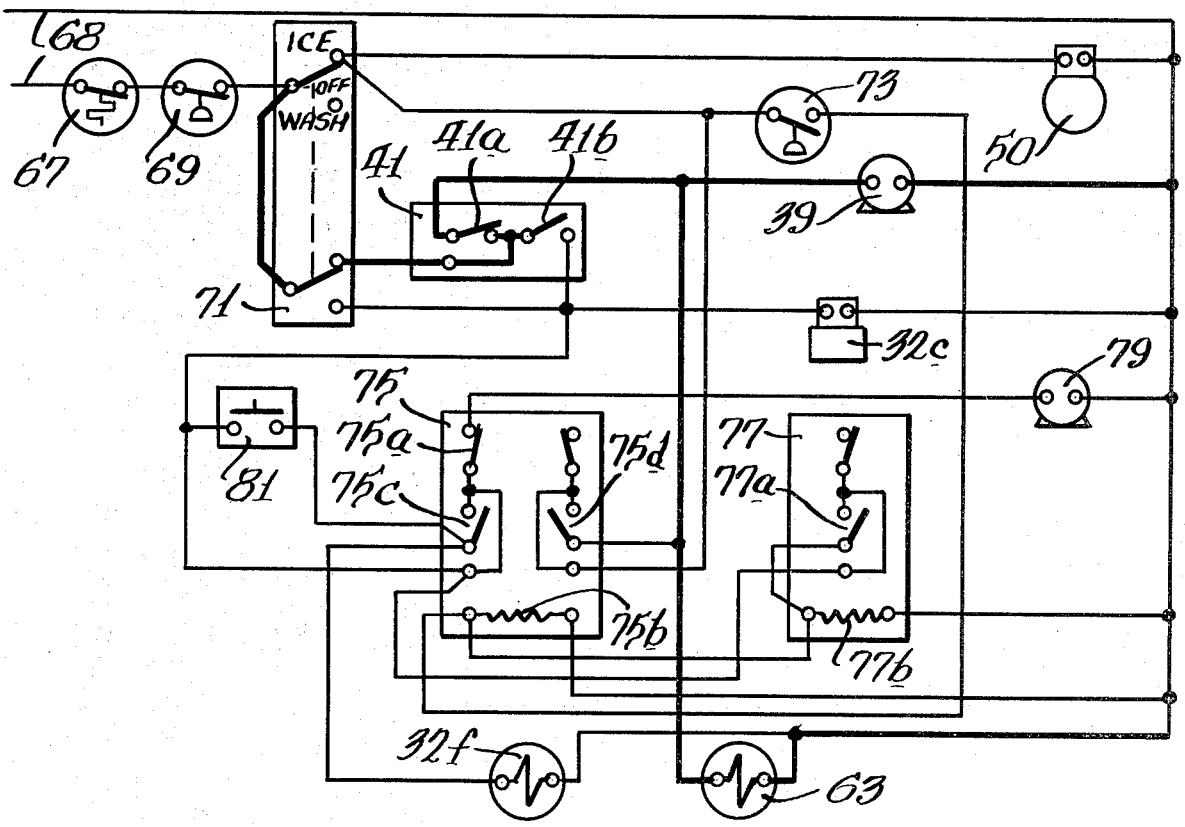
FIG. 15 shows the circuit diagram of FIG. 12 as controlled by the harvest motor cam during the hot gas application in the harvest portion of the cycle.

Referring now to the circuit diagrams of FIGS. 12 through 14, it is noted that these circuit diagrams disclose the switch positions of the various control elements during the various portions of the ice making cycle. Referring to FIG. 12, there is shown the compressor 50, the harvest motor 39, the water pump 32*c*, the hot gas solenoid 63 and the water purge solenoid valve 32*f*, which have been described above in connection with the physical configuration of the ice cube making apparatus 11. Reference has also been made to the cam operated switch 41 which is shown in FIG. 12 as controlling the harvest motor 39.

Also included in the control circuit is a bin control switch 67 which is shown in series with one side of a power supply line 68. The bin control switch is a conventional type of control used in ice machines to terminate operation of the ice making apparatus when the level of ice in the storage bin has reached a certain level. The switch may be either mechanically or thermally actuated by the ice when it reaches a certain level in the storage bin to open the power supply to the ice machine. Also connected in series with one side of the line 68 is a high pressure switch 69 which is used in models having water cooled condensers to disable the ice cube making machine 11 in the event that there is no water pressure in the supply for the condenser. Also shown in FIGS. 12–14 is a condenser fan motor 79 which is used only in ice machines having air cooled condensers. It is well known that condensers may be either air cooled or water cooled. In the case of a water cooled condenser, there would be no fan motor 79 in the circuit but there would be a disabling switch 69 to open the circuit to the ice machine in the event of a failure in the water pressure circulating water through the heat exchanger for the condenser.

The main control for the machine 11 consists of a manually operable switch 71 which may occupy either of three positions, the one shown in FIG. 12, which is for normal operation of the machine, indicated by the word "ice", an off position indicated by the word "off" or a wash position indicated by the word "wash" being for the purpose of purging or washing the reservoir and the associated plumbing.

The various functions of the machine 11 are controlled during the ice cube making cycle by four switches which include the cam switch 41, a low pressure refrigerant switch 73, a timer 75, and a relay 77. The low pressure refrigerant switch 73 is responsive to the refrigerant contained in the conduit 61 and does not close until a certain pressure level has been achieved within the conduit 61. Upon initiation of the ice making function by moving the switch 71 from the off to the ice making position, as shown in FIG. 12, the compressor 50 is connected directly across the power supply line 68 and thereby energized. As soon as the compressor 50 has achieved the predetermined pressure condition within the refrigerant line 61, the low pressure switch 73 closes, as shown in FIG. 13.

Prior to the operation of the low pressure switch 73, the only other elements of the machine 11 being energized as shown in FIG. 12 are the water pump 32*c* and the fan motor 79 (assuming an air cooled condenser) which are connected to the power supply line through the cam switch 41. In this initial condition of the circuit, the harvest motor 39 and its associated cam and slip clutch 40 are positioned as shown in FIG. 9 of the drawings with the follower 43 engaged with the cam surface 40*i* resulting in the switch 41 occupying the positions shown in FIG. 12, i.e., an open circuit to harvest motor 39 and a closed circuit to the water pump 32*c*. The fan motor 79 is energized through the normally closed contact 75*a* in the timer 75 as shown in FIG. 12. Consequently, during the operation at the initial portion of the cycle, the compressor 50, the water pump 32*c* and the fan motor 79 are energized.

The closure of the pressure switch 73 actuates the timer 75 by connecting the timer motor as represented by resistance 75*b* into the circuit. The timer 75 also includes switch contacts 75*c* and 75*d* which remain open until the timer 75 runs for its preset period of time after which contacts 75*c* and 75*d* will close. Upon energization of the timer motor 75*b* as illustrated in FIG. 13, the switch contacts 75*a* remain closed and the time switch 75 continues to maintain the fan motor 79 in operation.

To maintain the continued operation of the timer 75, a relay having normally open switch contacts 77*a* and a holding coil 77*b* are provided. Upon energization of the timer motor 75*b* and the relay 77 is also energized causing the switch contacts 77*a* to be closed.

FIG. 14 illustrates the condition of the circuit components upon expiration of the preset time for which the timer 75 has been set, at which time both of the switches 75*c* and 75*d* are closed and the switch 75*a* is opened switching the circuit connections shown in FIG. 13 to the connections shown in FIG. 14. As shown in FIG. 14, the fan motor 79 is disconnected while the water purge solenoid 32*f* is connected in circuit through the switch 75*c*, and the hot gas solenoid 63 and the harvest motor 39 are connected in circuit through the switch 75*d*. Thus, at the end of the predetermined time for which the timer 75 is set, the freezing portion of the cycle is terminated and the harvest portion of the cycle begins with the energization of the hot gas solenoid 63 and the harvest motor 39. The energization of the hot gas solenoid 63 causes the hot gas to flood through the evaporator coil 17 while at the same time the harvest motor 39 advances probe 37 into engagement with the ice slab 27. The cam switch 41 remains in the open position, as shown in FIGS. 12 through 14, as the driven member 40 rotates from the position shown in FIG. 9 clockwise advancing the probe 37 into engagement with the slab 27. This engagement occurs after about 45° of rotation of the driven member 40. Thereafter, the cam and slip clutch 40 permit the motor 39 to continue operating while the probe 37 maintains a constant force against the slab of ice 27. During initiation of the harvest portion of the cycle as shown in FIG. 14, the timer motor 75*b* continues to be energized by the circuit connection through relay switch 77*a* and the cam switch 41.

As soon as the hot gas melts the ice slab 27 sufficiently to permit the probe 37 to displace the slab with respect to the evaporator plate 13, the cam and slip clutch 40 will rotate as a unit causing the cam switch 41 to be closed after the driven member 40*d* has rotated more than 90° bringing the follower 43 into engagement with the cam surface 40*j*. When this has been accomplished, the cam switch 41 connects the harvest motor directly in circuit through the switch contacts 41*a* which have been open until that time. At the same time the switch contacts 41*b* are opened thereby disconnecting the circuit connection to the water purge solenoid 32*f*. The opening of switch contacts 41*b* also deenergizes the timer motor 75*b* and opens the relay 77 and its associated switch contacts 77*a*. The cam switch 41, therefore, maintains the hot gas solenoid 63 and the harvest motor 39 in circuit until the driven member 40*d* and its associated cam surface advances to the position shown in FIG. 9 at which time the switch 41 reverts to the circuit connection shown in FIG. 12 in which the contacts 41*a* are open and the contacts 41*b* are closed. At that time the compressor resumes delivery of low pressure liquid to the evaporator coil 17 commencing the reduction of the pressure again to close the switch 73 to restart the timer and begin the next cycle.

In order to permit manual purging of the water reservoir 31, there is provided a switch 81 which may be manually operated to energize the purge solenoid 32*f*. Energization of solenoid 32*f* while the water pump 32*c* is operating causes the impurities in the sump 31*b* of the reservoir 31 to be flushed to the drain as described above.

The above-described control circuit provides a simple and effective means of operating the various mechanical and electrical components of the ice machine 11. It should be understood that the timer 75 and relay 77 may be replaced by electronic timing means which could perform the same switching and control functions using different circuitry. The essential or required functions to be performed by the control circuit are that of providing a timed freezing period during which ice cubes are formed followed by a harvest period during which mechanical means apply a predetermined force against the formed ice slab until it is displaced from the evaporator and means terminating the hot gas harvesting in response to the completion of the harvesting by the mechanical means. The above-described functions included in the ice making cycle and performed by the simple machine disclosed herein provide the basis for an improved cube ice making machine which functions effectively and efficiently under a wide range of ambient conditions in a manner not heretofore known in the art.

To appreciate the advantages and simplicity of my invention, it should be understood that the harvest motor 39 may be of very low power with the cam and slip clutch 40 adjusted to deliver a force through the probe 37 of on the order of 1 pound or less. This very minute of force is sufficient to overcome the capillary force exerted by the water layer between the ice slab 27 and the evaporator plate 13. However, the motor serves not only to deliver this minimum amount of force but also serves to sense the displacement of the ice slab 27 and terminate the harvest portion of the cycle as the cam 40 rotates to its initial position as shown in FIG. 9. The performance of these dual functions in the harvesting of the slab and terminating the harvest portion of the cycle by the inexpensive timer motor 39 results in a low cost design which is superior in performance to the more complex prior art devices.

While there has been shown and described a preferred embodiment of the present invention, it will be apparent to those skilled in the art that various changes and modifications may be made without departing from the invention in its broader aspects and it is, therefore, contemplated in the appended claims to cover all such changes and modifications that fall within the true spirit and scope of the present invention.

What is claimed as new and desired to be secured by Letters Patent of the United States is:

1. An ice cube maker comprising a vertically disposed flat plate having refrigeration evaporator coil mounted on one side thereof in good heat exchange relation therewith and lattice forming cube molds on the other side thereof, said lattice including horizontally and vertically extending intersecting walls forming sidewardly opening pockets within which water may be frozen to form ice cubes, means supplying water across the top of said plate so the water traverses said lattice, means delivering refrigerant liquid to said coil to freeze water to form ice cubes in said lattice with bridging portions forming a slab of ice including said cubes, means for alternatively supplying hot gas to said coil to separate said slab from said plate during an ice harvesting period, probe means for applying a horizontal force to said slab inwardly of the edges to displace said slab from said lattice, said probe applying a predetermined limited force sufficient to displace said slab when completely separated from said lattice but less than that which would fracture the bridging portions of said slab.

2. The combination of claim 1 wherein said probe means comprises a plunger mounted for reciprocating movement normal to said slab and movable through an opening in said plate into engagement with said slab.

3. The combination of claim 2 wherein said plunger is driven by a constant force drive so as to apply a predetermined force on said slab.

4. The combination of claim 3 wherein said plunger is displaced horizontally from the center of said plate to apply a turning moment to said slab to release the capillary water force retaining said slab in said lattice.

5. The combination of claim 1 wherein said probe means is horizontally offset from the center of said plate to apply a twisting moment to said slab to drain the water between said slab and said plate to release the capillary attractive force holding said slab to said plate.

6. The combination of claim 1 wherein said probe means comprises a reciprocating plunger.

7. In a cube ice making machine the combination comprising a refrigeration system including a compressor and an evaporator with means distributing a low pressure liquid refrigerant from said compressor to said evaporator, an ice cube forming lattice in good heat transfer relation with said evaporator and means circulating water to said lattice to be frozen into cubes, a pressure responsive switch to initiate the cube making cycle when said compressor achieves a predetermined reduced pressure in said distributing means, a timer controlled by said pressure responsive switch to continue the cube freezing portion of said cycle for a predetermined time after which said timer initiates the harvest portion of said cycle, mechanical means for displacing said ice cubes from said lattice during the harvest portion of said cycle, said cubes being formed into a slab of ice with bridging portions interconnecting rows of cubes, a hot gas solenoid actuated by said timer at the start of the harvest portion of said cycle to deliver hot gas from said compressor to said evaporator and terminate distribution of said liquid refrigerant to said evaporator, said mechanical means applying a force against a central portion of said slab of ice to overcome the capillary forces retaining said slab in said evaporator after said hot gas has melted the ice retaining said slab to said lattice.

8. The combination of claim 7 wherein said mechanical means comprises a harvest motor which is drivingly connected to recriprocate a probe, an opening in said evaporator through said probe is reciprocated during the harvest portion of the cycle to displace said slab of ice.

9. The combination of claim 8 including force limiting means associated with said harvest motor and probe whereby said probe delivers a predetermined force to said slab of ice, said force being sufficiently low so that the slab of ice will not be broken and will be harvested in one piece and sufficiently high to overcome said capillary forces as soon as the ice in said slab has melted at the interface with said lattice.

10. The combination of claim 9 wherein said force limiting means comprises a slip clutch which permits said probe to be driven into engagement with said ice slab and then to maintain said predetermined force on said slab until said hot gas melts said ice sufficiently for said probe to continue its movement through said opening in said evaporator to displace said ice slab from said lattice.

11. The combination of claim 8 wherein said harvest motor drives a first rotary member of a slip clutch, a second rotary member retained in frictional driven engagement with said first member to limit the torque transmitted between said first and second members, said probe being connected to said second member to reciprocate rectilinearly as said second member is rotated by said harvest motor, said probe during the harvest portion of said cycle being driven into engagement with said ice slab, maintaining a constant force on said ice slab through said slip clutch until said ice slab is thawed sufficiently to permit further movement of said probe through said opening to complete displacement of said slab from said lattice.

12. The combination of claim 11 including a cam operated switch associated with said second rotary member to maintain energization of said harvest motor after said timer has commenced the harvest portion of said cycle and to terminate operation of said harvest motor after the harvesting of said slab of ice has been completed.

13. The combination of claim 7 wherein said water circulating means comprises a pump which circulates water from a reservoir disposed below said evaporator to a water distribution means for delivering water across the top of said lattice portion of said evaporator, said pump being operated continuously during said ice making cycle except that during the operation of said mechanical means for displacing said ice cubes said pump is rendered inoperative in delivering water to the evaporator.

14. The combination of claim 13 wherein said pump and said water distribution means are connected by a conduit which also includes a solenoid valve controlled drain line which permits purging of said reservoir water to the drain when said solenoid valve is actuated to open said valve, said solenoid valve being operated momentarily after completion of said freezing portion of said cycle to purge impurities from said reservoir.

15. The combination of claim 7 wherein said mechanical means comprises a reciprocating plunger which is advanced through an opening in the evaporator to engage and displace said slab of ice from said lattice, said opening in said evaporator being displaced slightly from the geometric center of said evaporator and its associated lattice whereby said plunger cocks said slab of ice as it displaces it from the said lattice.

16. The combination of claim 15 wherein said opening is displaced between one half and one cube width from the geometric center of said lattice.

17. An ice cube making machine comprising an evaporator having a flat rectangular base portion with a tortuous refrigerated coil disposed on one side thereof and a cube forming mold on the other side thereof, a refrigeration system having a compressor for delivering low pressure liquid refrigerant to said coil during the freezing portion of the ice making cycle and for delivering hot gas to said coil during the harvesting portion of said cycle, a mechanical harvesting means including a harvest motor which is drivingly connected to reciprocate a probe, said base portion of said evaporator having an opening disposed near the geometric center of said rectangular base portion, said harvesting means during the harvesting portion of said cycle driving said probe through said opening into engagement with a slab of ice formed in said mold to displace said slab therefrom in one piece, a control circuit having means for initiating said freezing portion of said cycle when said compressor attains a predetermined pressure at said evaporator and having timer means for terminating said freezing portion of said cycle after a predetermined period and commencing the harvesting portion of said cycle.

18. The combination of claim 17 wherein the hot gas elivered to the evaporator coil at the beginning of the harvest portion of the cycle melts the ice at the interface between the ice slab and said mold, said probe engaging said ice slab after the initiation of said hot gas applying sufficient force to overcome the capillary water forces retaining said slab within said mold.

19. The combination of claim 18 wherein said opening in said evaporator base portion is displaced with respect to said geometric center so that said probe cocks said ice slab reducing the force necessary to drain the water trapped between said ice slab and said evaporator mold.

20. The combination of claim 17 having force limiting means between said motor and probe to limit the force applied to said ice slab to less than the force that would fracture said ice slab during harvesting by said probe.

21. The combination of claim 18 including a slip clutch drivingly connecting said motor and said probe, said probe being driven into engagement with said ice slab and maintaining a predetermined force on said slab until said hot gas has melted the ice at the interface between said slab and said mold.

* * * * *